US009855771B2

(12) United States Patent
Sugiyama et al.

(10) Patent No.: US 9,855,771 B2
(45) Date of Patent: Jan. 2, 2018

(54) SHEET TRAY

(71) Applicant: BROTHER KOGYO KABUSHIKI KAISHA, Nagoya-shi, Aichi-ken (JP)

(72) Inventors: Wataru Sugiyama, Nishio (JP); Yoshiyuki Washino, Gifu-ken (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/412,686

(22) Filed: Jan. 23, 2017

(65) Prior Publication Data

US 2017/0217222 A1 Aug. 3, 2017

(30) Foreign Application Priority Data

Jan. 29, 2016 (JP) ..... 2016-016633

(51) Int. Cl.

| | |
|---|---|
| ***B65H 31/20*** | (2006.01) |
| ***B41J 11/58*** | (2006.01) |
| ***G03G 15/00*** | (2006.01) |
| ***B65H 1/04*** | (2006.01) |

(52) U.S. Cl.

CPC ..... *B41J 11/58* (2013.01); *B65H 1/04* (2013.01); *B65H 31/20* (2013.01); *G03G 15/6552* (2013.01); *B65H 2405/1122* (2013.01); *B65H 2405/11164* (2013.01)

(58) Field of Classification Search

CPC ..... B65H 31/20; B65H 2405/11164; B65H 2405/3322; B65H 2405/1122; B65H 2405/1119

See application file for complete search history.

(56) References Cited

U.S. PATENT DOCUMENTS

| | | | | |
|---|---|---|---|---|
| 8,622,382 | B2 * | 1/2014 | Jang | B65H 1/266 271/145 |
| 9,238,564 | B2 * | 1/2016 | Washino | B65H 1/04 |
| 2009/0194935 | A1 | 8/2009 | Wakakusa et al. | |
| 2010/0124449 | A1 | 5/2010 | Asada et al. | |
| 2013/0009360 | A1 * | 1/2013 | Ma | G03G 15/6552 271/279 |
| 2016/0347570 | A1 * | 12/2016 | Sugiyama | B65H 31/20 |
| 2017/0174464 | A1 * | 6/2017 | Tanaka | B65H 31/20 |

FOREIGN PATENT DOCUMENTS

| | | | |
|---|---|---|---|
| JP | 2003112847 A | * | 4/2003 |
| JP | 2010-173832 A | | 8/2010 |
| JP | 2013018581 A | * | 1/2013 |

* cited by examiner

*Primary Examiner* — Luis A Gonzalez
(74) *Attorney, Agent, or Firm* — Merchant & Gould P.C.

(57) ABSTRACT

A sheet tray includes a first tray and a second tray each including a first friction portion or a first contact portion, and a second friction portion or a second contact portion. In a process of movement of the second tray from a first position to a second position, the first friction portion contacts the first contact portion to deform the first contact portion and starts returning the first contact portion from a deformed shape to an original shape when the second tray is located at a position spaced apart from the second position in a second direction. The second friction portion contacts the second contact portion when the second tray moved from the first position in a first direction has reached the second position, and the second friction portion deforms the second contact portion when the second tray is moved from the second position in the first direction.

17 Claims, 11 Drawing Sheets

SHEET TRAY

CROSS REFERENCE TO RELATED APPLICATION

The present application claims priority from Japanese Patent Application No. 2016-016633, which was filed on Jan. 29, 2016, the disclosure of which is herein incorporated by reference in its entirety.

BACKGROUND

The following disclosure relates to a sheet tray for supporting a sheet.

Many image recording apparatuses such as printers are provided with a sheet tray for supporting a sheet on which an image is recorded. Some sheet trays can be extended and contracted in a plurality of steps so as to support sheets of various sizes.

For example, there is known an image recording apparatus including a sheet-output tray and a subsidiary tray movable with respect to the sheet-output tray. The subsidiary tray is movable to (i) a retracted position at which the subsidiary tray is stored in the sheet-output tray, (ii) a small protruding position at which the subsidiary tray protrudes from the sheet-output tray by a small amount, and (iii) a large protruding position at which the subsidiary tray protrudes from the sheet-output tray by a large amount.

Each of the subsidiary tray and the sheet-output tray is provided with a protrusion. These protrusions contact each other to keep the subsidiary tray at the small protruding position. This contact also applies a click feeling to a user when the subsidiary tray is moved from the retracted position to the small protruding position. When one of the protrusions is moved beyond the other, the subsidiary tray is movable from the small protruding position to the large protruding position.

SUMMARY

In the case where the sheet-output tray and the subsidiary tray are constructed as described above, the pair of protrusions have to have two functions: a first function for applying the click feeling and keeping the subsidiary tray at the small protruding position; and a second function for enabling the subsidiary tray to move from the small protruding position to the large protruding position. It is however difficult to maintain good operation feeling while achieving the two functions.

For example, the second function is not achieved sufficiently in the case where the trays are constructed so as to make it difficult for one of the protrusions to move beyond the other in order to achieve the first function well. On the other hand, the first function is not achieved sufficiently in the case where the trays are constructed so as to make it easy for one of the protrusions to move beyond the other in order to achieve the second function well.

Also, in the case where the subsidiary tray located at the retracted position is moved to the small protruding position with respect to the sheet-output tray with great force, one of the protrusions may move beyond the other without stopping, so that the subsidiary tray may pass through the small protruding position.

Accordingly, an aspect of the disclosure relates to a sheet tray extendable and contractable in a plurality of steps and capable of applying a clear click feeling at arrival at a particular extension/contraction position, with a small load required for extension from the extension/contraction position.

In one aspect of the disclosure, a sheet tray includes: a first tray including a first support surface that supports a sheet; and a second tray including a second support surface that supports the sheet, the second tray being movable with respect to the first tray in a first direction. The second tray is movable to a first position, a second position, and a third position. When the second tray is located at the first position, an overlapping area which is an area on which the second support surface overlaps the first support surface in plan view is a first area. The second position is spaced apart from the first position at a first distance in the first direction, and when the second tray is located at the second position, the overlapping area is a second area which is less than the first area. The third position is spaced apart from the second position at a second distance in the first direction, and when the second tray is located at the third position, the overlapping area is a third area which is less than the second area. The first tray includes: one of a first friction portion and a first contact portion deformable elastically; and one of a second friction portion and a second contact portion deformable elastically. The second tray includes: another of the first friction portion and the first contact portion deformable elastically; and another of the second friction portion and the second contact portion deformable elastically. The second contact portion differs from the first contact portion in position in a widthwise direction which is orthogonal to the first direction and along the first support surface. In a process of movement of the second tray from the first position to the second position, the first friction portion contacts the first contact portion to elastically deform the first contact portion and thereafter starts elastically returning a shape of the first contact portion from an elastically deformed shape to an original shape thereof when the second tray is located at a position spaced apart from the second position at a third distance in a second direction reverse to the first direction. The second friction portion contacts the second contact portion at a point in time when the second tray moved from the first position in the first direction has reached the second position, and thereafter the second friction portion elastically deforms the second contact portion when the second tray is moved from the second position in the first direction.

In another aspect of the disclosure, a sheet tray includes: a first tray having a first support surface configured to support a sheet; and a second tray having a second support surface configured to support the sheet, the second tray being configured to move relative to the first tray in a first direction from a first position via a second position to a third position, the second support surface of the second tray located at the first position overlapping the first support surface by a first area, the second support surface of the second tray located at the second position overlapping the first support surface by a second area less than the first area, and the second support surface of the second tray located at the third position overlapping the first support surface by a third area less than the second area. The first tray includes: one of a first friction portion and a first contact portion deformable elastically; and one of a second friction portion and a second contact portion deformable elastically. The second tray includes: the other of the first friction portion and the first contact portion; and the other of the second friction portion and the second contact portion. The first contact portion and the second contact portion are located at different positions in a width direction which is orthogonal to the first direction and parallel to the first support surface.

The first friction portion is configured to: when the second tray moves in the first direction from the first position toward the second position, contact and elastically deform the first contact portion to a deformed shape; and when the second tray reaches a position upstream of the second position in the first direction, start elastically returning the first contact portion from the deformed shape to an original shape. The second friction portion is configured to: when the second tray reaches the second position from the first position, contact the second contact portion; and when the second tray leaves the second position in the first direction, elastically deform the second contact portion to a deformed shape.

BRIEF DESCRIPTION OF THE DRAWINGS

The objects, features, advantages, and technical and industrial significance of the present disclosure will be better understood by reading the following detailed description of the embodiment, when considered in connection with the accompanying drawings, in which.

DETAILED DESCRIPTION OF THE EMBODIMENT

Hereinafter, there will be described a multi-function peripheral (MFP) 10 according to one embodiment by reference to the drawings. It is to be understood that the following embodiment is described only by way of example, and the disclosure may be otherwise embodied with various modifications without departing from the scope and spirit of the disclosure. The MFP 10 is used in a state illustrated in FIG. 1. In the following description, an up and down direction 7 is defined in this state. Also, a front and rear direction 8 is defined by regarding a side of the MFP 10 on which an opening 13 is formed as a front side (a front surface). A right and left direction 9 is defined in a state in which the MFP 10 is viewed from the front. The up and down direction 7, the front and rear direction 8, and the right and left direction 9 are orthogonal to each other.

Overall Construction of MFP 10

Figure 1:
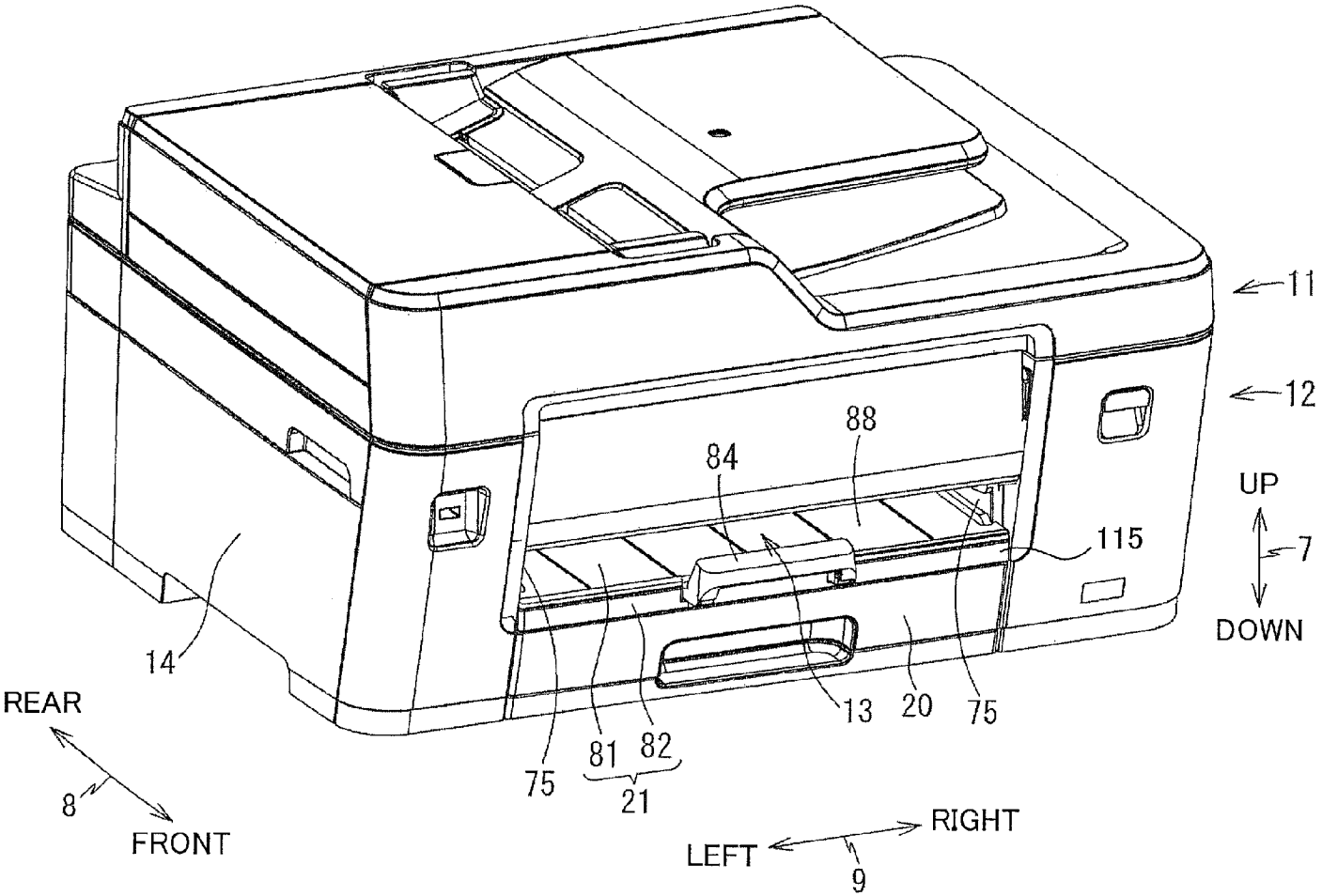
FIG. 1 is a perspective view of a multi-function peripheral (MFP)

As illustrated in FIG. 1, the MFP 10 includes a scanner 11 at its upper portion and a printer 12 at its lower portion. The scanner 11 obtains image data by reading an image recorded on a document. The printer 12 as one example of an image recording apparatus records an image on a sheet 15 (see FIG. 2) based on, e.g., image data.

The scanner 11 in the present embodiment is what is called a flatbed scanner, and a detailed description of the scanner 11 is dispensed with. The printer 12 includes a conveyor and an image recorder 24 (see FIG. 2) that records an image on the sheet 15.

The conveyor includes: a housing 14 (see FIG. 1) having a conveyance path 23 through which the sheet 15 is to be conveyed; a supply tray 20 (see FIGS. 1 and 2); a supply roller 25 (see FIG. 2); a conveying roller pair 63 (see FIG. 2); an output roller pair 66 (see FIG. 2); and an output tray 21 (see FIGS. 1 and 2) as one example of a sheet tray.

As illustrated in FIG. 1, the housing 14 has an opening 13 in its front portion. The supply tray 20 is insertable into the housing 14 through the opening 13 in the rear direction. The supply tray 20 is mounted in the housing 14 in FIG. 1. The supply tray 20 in this state is removable through the opening 13 in the front direction. The supply tray 20 is capable of storing various sizes of the sheets 15.

Figure 2:
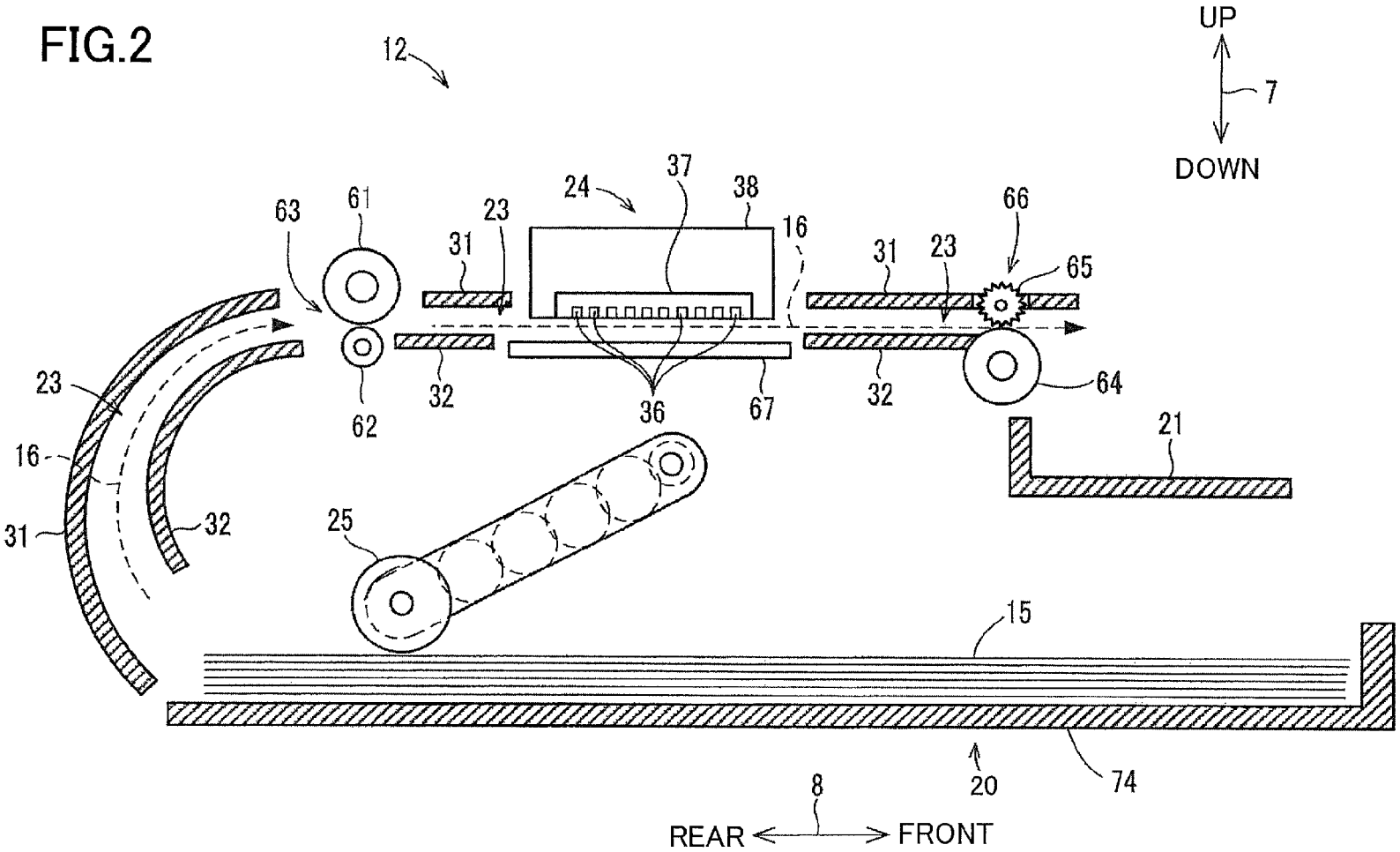
FIG. 2 is an elevational view in vertical cross section schematically illustrating an internal structure of a printer.

As illustrated in FIG. 2, the supply tray 20 includes: a bottom plate 74 that supports the sheet 15; and a pair of side plates, not illustrated, provided upright respectively on right and left ends of the bottom plate 74. The sheet 15 placed on the bottom plate 74 is supplied to the conveyance path 23 by the supply roller 25 that is rotated by power transmitted from a motor, not illustrated.

The conveyance path 23 makes an upward U-turn from a rear end portion of the supply tray 20 and extends frontward to the output tray 21. The conveyance path 23 is defined by a first guide member 31 and a second guide member 32 which are opposed to each other at a predetermined distance therebetween. The sheet 15 is supplied from the supply tray 20 to the conveyance path 23 and conveyed along the conveyance path 23 in a conveying direction 16 indicated by the broken-line arrows illustrated in FIG. 2.

The conveying roller pair 63 and the output roller pair 66 are provided in the housing 14. The conveying roller pair 63 is provided on the conveyance path 23 at a position located upstream of the image recorder 24 in the conveying direction 16. The conveying roller pair 63 includes a conveying roller 61 and pinch rollers 62. The pinch rollers 62 are held in pressing contact with a roller surface of the conveying roller 61 by elastic components, not illustrated, such as springs. The output roller pair 66 is provided on the conveyance path 23 at a position located downstream of the image recorder 24 in the conveying direction 16. The output roller pair 66 includes an output roller 64 and spurs 65. The spurs 65 are held in pressing contact with a roller surface of the output roller 64 by elastic components, not illustrated, such as springs. Each of the conveying roller 61 and the output roller 64 are rotated by the power transmitted from the motor, not illustrated. This rotation conveys the sheet 15 in the conveying direction 16, with the sheet 15 nipped between the conveying roller 61 and the pinch rollers 62 or between the output roller 64 and the spurs 65.

The image recorder 24 is disposed on an upper side of the conveyance path 23 in the housing 14. The image recorder 24 includes a recording head 37 and a carriage 38 on which the recording head 37 is mounted. The recording head 37 has a multiplicity of nozzles 36. Ink supplied from ink cartridges, not illustrated, is ejected by the recording head 37 toward a platen 67 through the nozzles 36. The platen 67 is shaped like a plate which supports the sheet 15 conveyed through the conveyance path 23. The platen 67 is disposed on a lower side of the conveyance path 23 and opposed to the recording head 37. The carriage 38 is supported by a frame disposed in the housing 14, such that the carriage is reciprocable in the right and left direction 9 as one example of a widthwise direction. During reciprocation of the carriage 38, the recording head 37 ejects ink droplets from the nozzles 36 onto the sheet 15 supported on the platen 67 and conveyed along the conveyance path 23. As a result, an image is formed on the sheet 15. In the present embodiment, the image recorder 24 is an ink-jet image recording device but may be an electronic-photographic image recording device, for example.

The sheet 15 supported on the supply tray 20 is supplied to the conveyance path 23 by the supply roller 25. The sheet 15 supplied to the conveyance path 23 is conveyed by the conveying roller pair 63 to the image recorder 24 which records an image on the conveyed sheet. The sheet 15 is then conveyed frontward by the output roller pair 66 and discharged onto the output tray 21.

Output Tray 21

Figure 3:
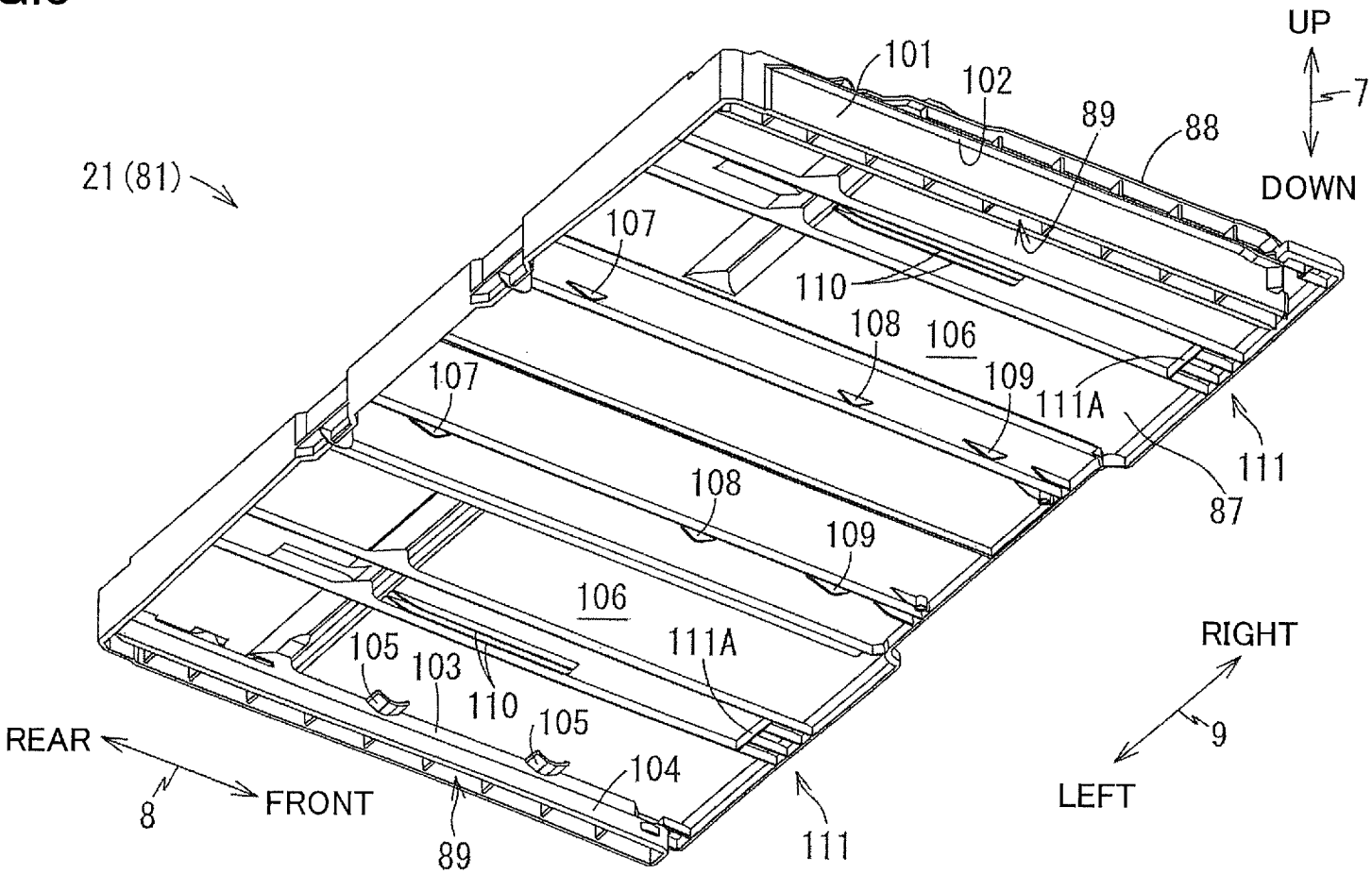
FIG. 3 is a perspective view of a first tray.
Figure 4:
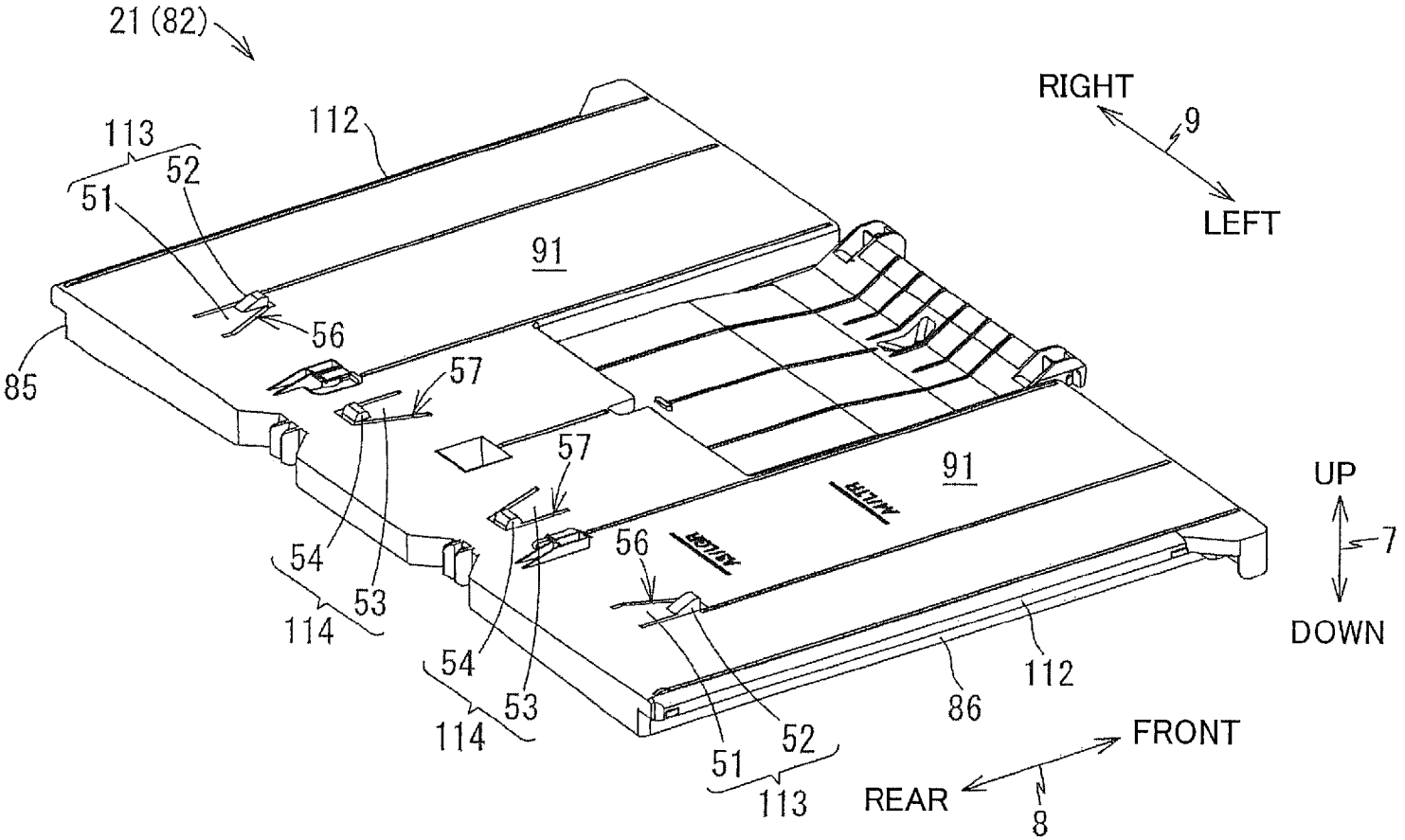
FIG. 4 is a perspective view of a second tray.

The output tray 21 includes a first tray 81 illustrated in FIG. 3 and a second tray 82 illustrated in FIG. 4.

The first tray 81 is supported at its right and left end portions (specifically, a pair of side plates 89 which will be described below) by supporters, not illustrated, which protrude in the right and left direction 9 respectively from a pair of inside surfaces 75 (see FIG. 1) of the housing 14. It is noted that the first tray 81 may be supported by the supply tray 20. For example, the first tray 81 may be supported by a pair of side plates provided upright respectively on right and left ends of the bottom plate 74 of the supply tray 20.

The second tray 82 is supported by the first tray 81 so as to be movable with respect to the first tray 81 in the front and rear direction 8. The second tray 82 is drawn out from the first tray 81 in the front direction that coincides with a direction in which the sheet 15 is discharged (see FIGS. 7-10). The front direction is one example of a first direction. Also, the second tray 82 is inserted into the first tray 81 in the rear direction and held in the first tray 81 (see FIGS. 5, 6A, and 6B). The rear direction is one example of a second direction.

Figure 5:
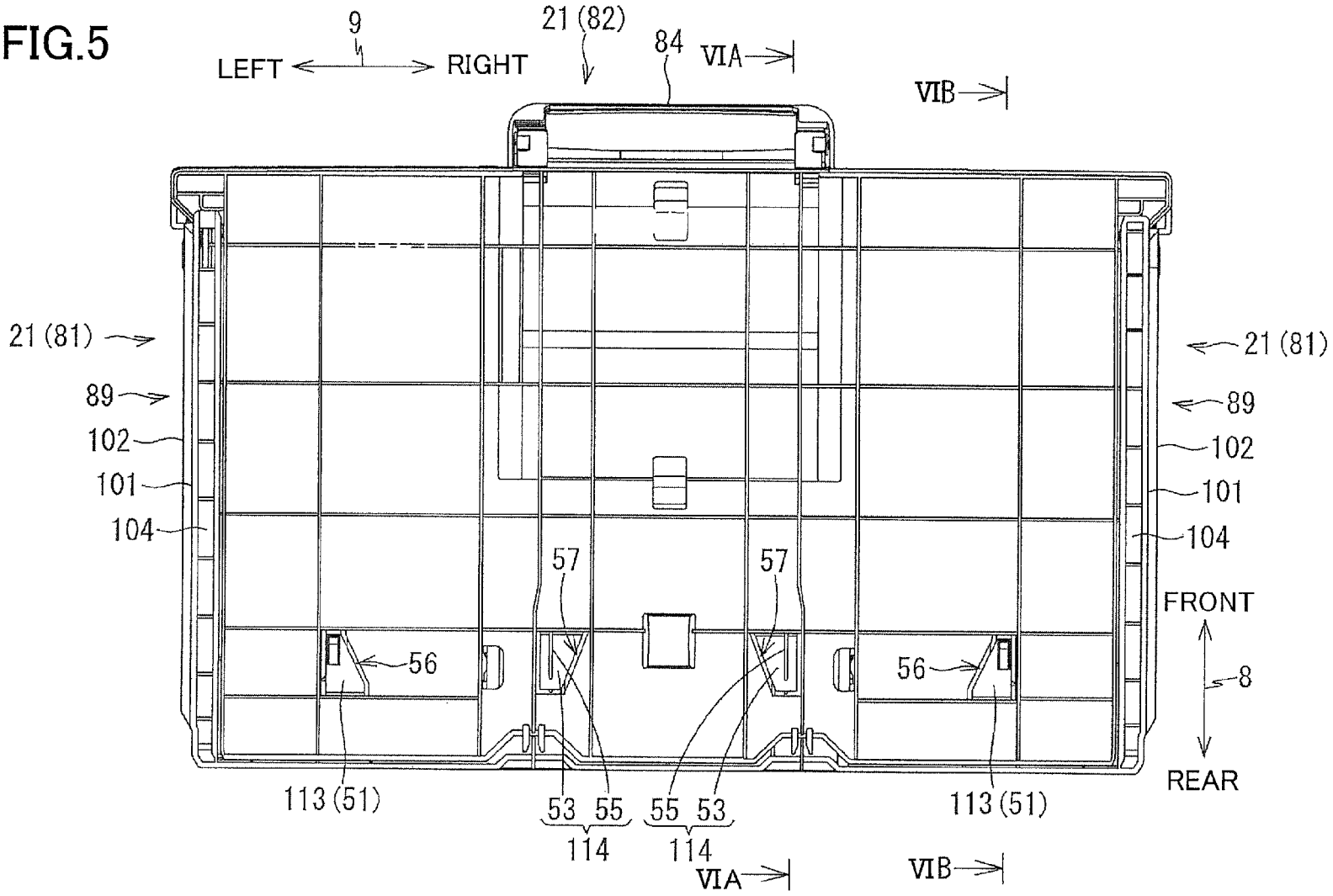
FIG. 5 is a bottom view of the first tray and a second tray located at a first position.
Figure 6A:
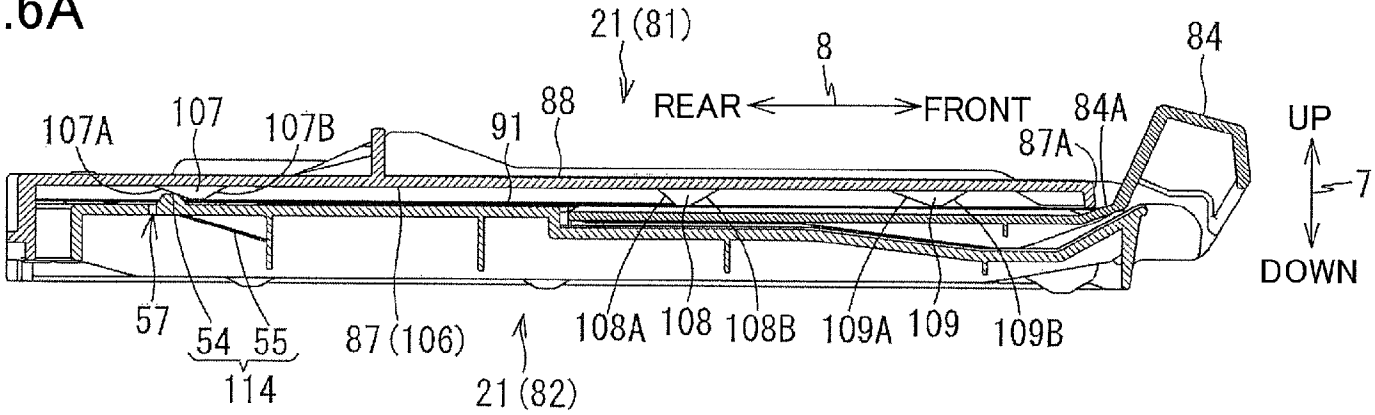
FIG. 6A is a cross-sectional view taken along line VIA-VIA in FIG. 5.
Figure 6B:
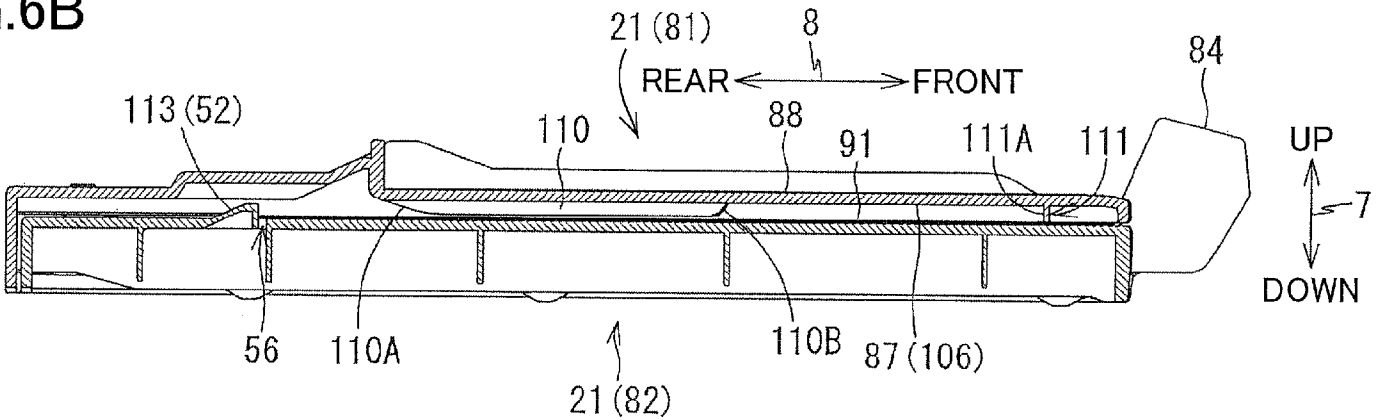
FIG. 6B is a cross-sectional view taken along line VIB-VIB in FIG. 5.

The output tray 21 is used in a state illustrated in FIGS. 5, 6A, and 6B in the case where image recording is performed on the sheet 15 of a small size such as a postcard and an L-size sheet. That is, the second tray 82 is fully held on the first tray 81 in this state, and the sheet 15 discharged frontward from the inside of the housing 14 is supported only by an upper surface 88 (as one example of a first support surface) of a support plate 87 of the first tray 81 which will be described below.

In the state illustrated in FIGS. 5, 6A, and 6B, the second tray 82 other than its front end portion (i.e., a protruding portion 84 which will be described below) overlaps the upper surface 88 of the support plate 87 of the first tray 81 in plan view (when viewed from an upper side of the second tray 82). The position of the second tray 82 illustrated in FIGS. 5, 6A, and 6B is defined as a first position. In plan view, the entire upper surface 91 (as one example of a second support surface) of the second tray 82 located at the first position overlaps the upper surface 88. It is noted that when the second tray 82 is located at the first position, a front portion of the upper surface 91 may be located in front of the upper surface 88. That is, only a portion of the upper surface 91 of the second tray 82 located at the first position may overlap the upper surface 88 in plan view.

Figure 7:
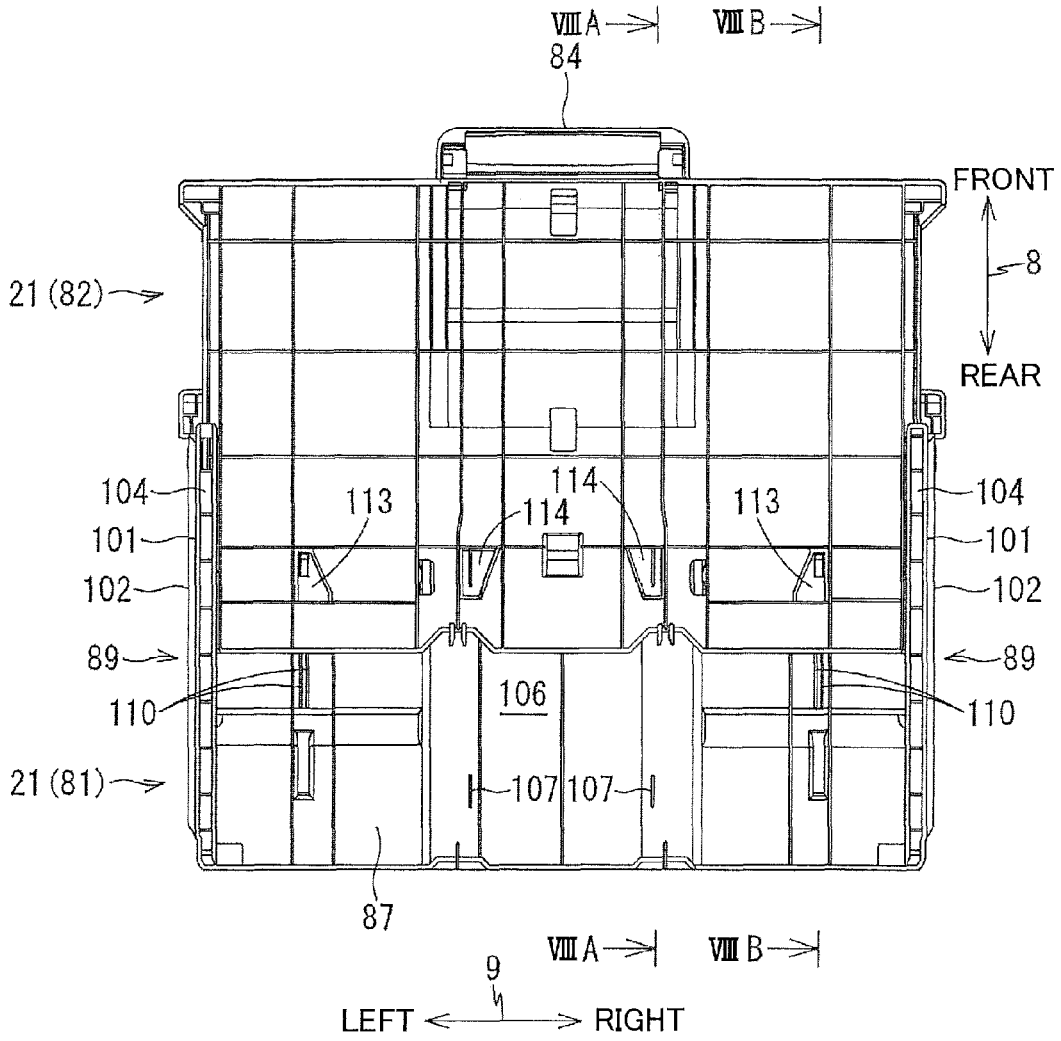
FIG. 7 is a bottom view of the first tray and the second tray located at a second position.
Figure 8A:
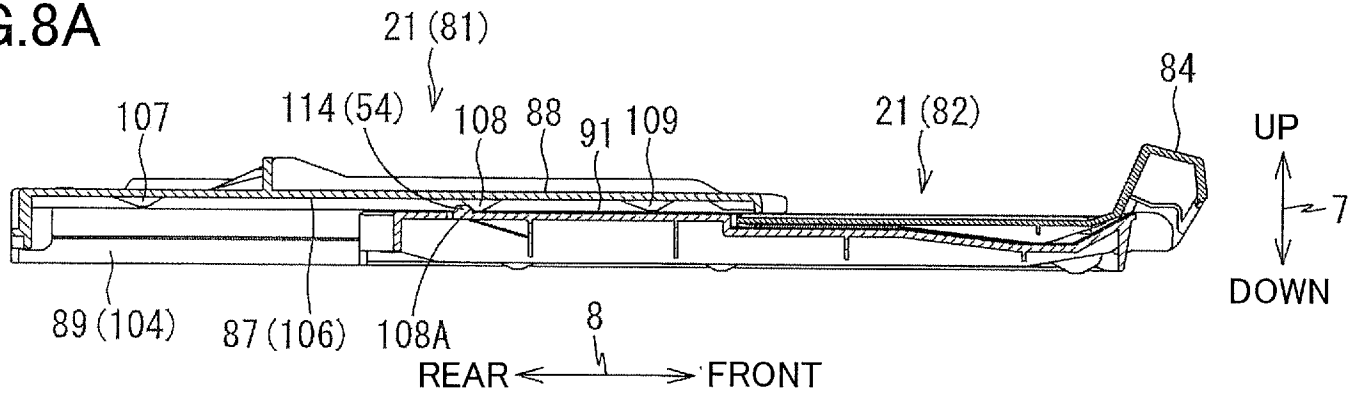
FIG. 8A is a cross-sectional view taken along line VIIIA-VIIIA in FIG. 7.
Figure 8B:
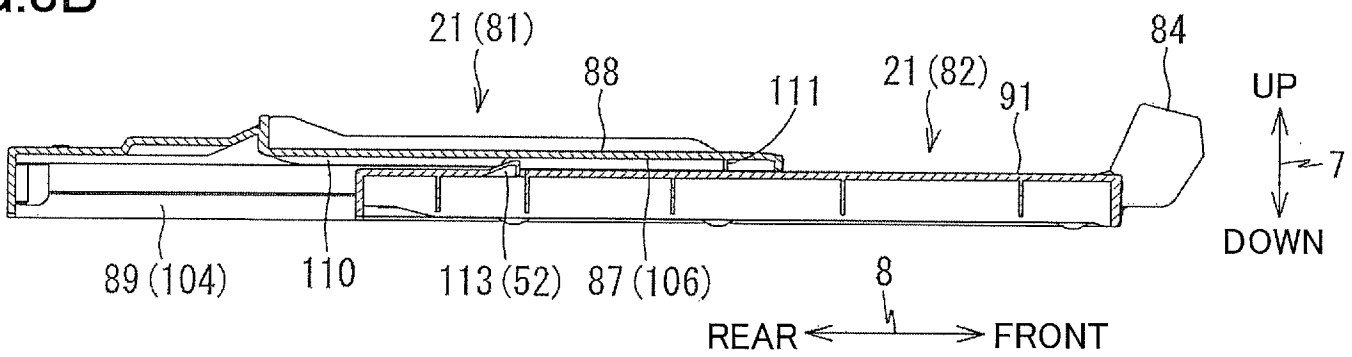
FIG. 8B is a cross-sectional view taken along line VIIIB-VIIIB in FIG. 7.

The output tray 21 is used in a state illustrated in FIGS. 7, 8A, and 8B in the case where image recording is performed on the sheet 15 of a size, such as the A4 size and the letter size, which is larger than the sizes of the sheet 15 used in the case where the output tray 21 is in the state illustrated in FIGS. 5, 6A, and 6B. That is, the second tray 82 is partly drawn out from the first tray 81. That is, the second tray 82 being in the state illustrated in FIGS. 7, 8A, and 8B is located further toward the front than when located at the first position illustrated in FIGS. 5, 6A, and 6B. In other words, a front end of the second tray 82 being in the state illustrated in FIGS. 7, 8A, and 8B is located further toward the front than when located at the first position illustrated in FIGS. 5, 6A, and 6B. When the output tray 21 is in the state illustrated in FIGS. 7, 8A, and 8B, the sheet 15 discharged frontward from the inside of the housing 14 is supported by the upper surface 88 of the support plate 87 of the first tray 81 and by the front portion of the upper surface 91 of the second tray 82.

In the state illustrated in FIGS. 7, 8A, and 8B, a substantially rear half portion of the upper surface 91 of the second tray 82 overlaps the upper surface 88 of the support plate 87 of the first tray 81 in plan view. The overlapping area between the upper surface 91 of the second tray 82 in this state and the upper surface 88 of the support plate 87 of the first tray 81 is smaller than the overlapping area between the upper surface 91 of the second tray 82 located at the first position and the upper surface 88 of the support plate 87 of the first tray 81. The position of the second tray 82 illustrated in FIGS. 7, 8A, and 8B is defined as a second position.

Figure 9:
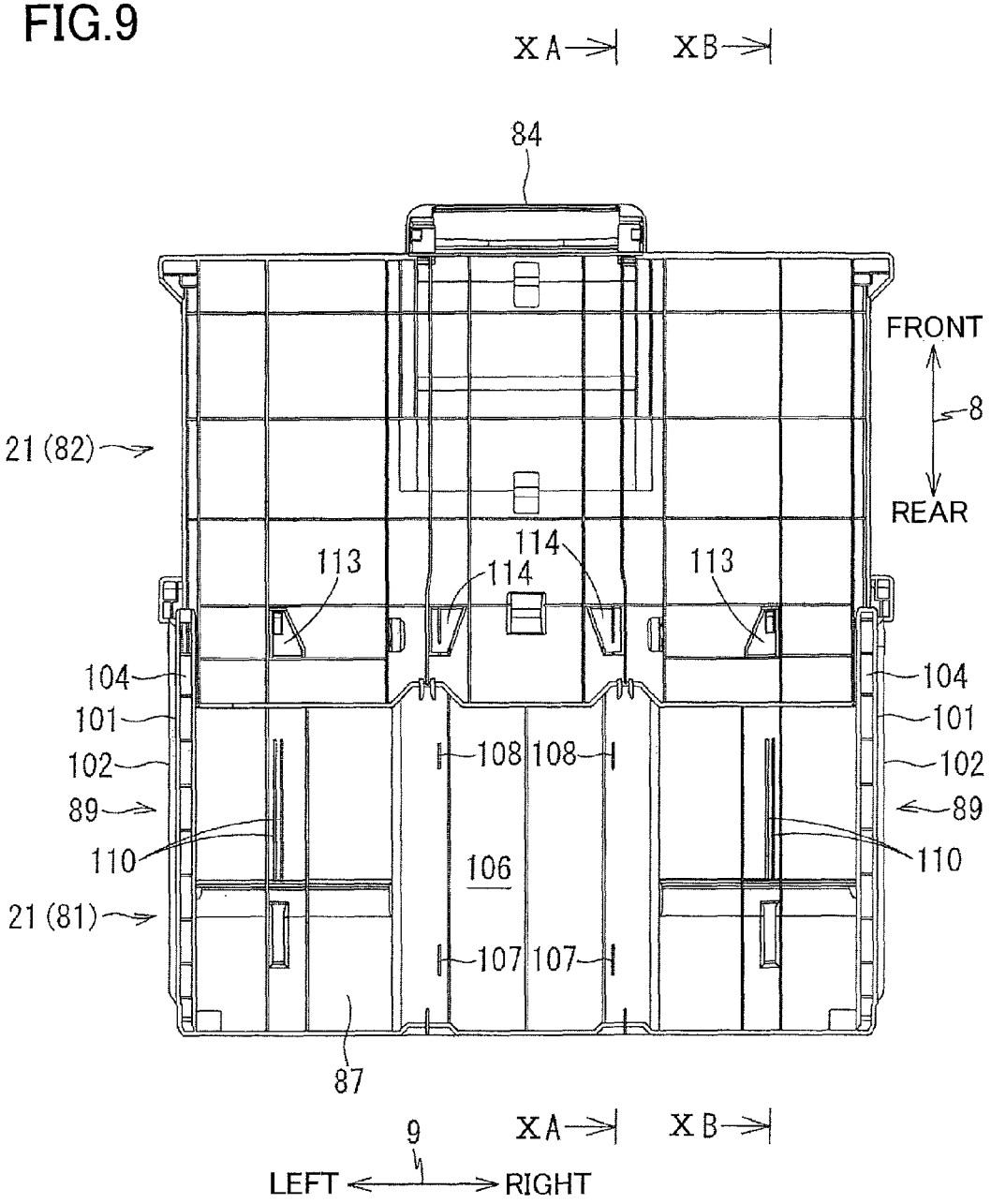
FIG. 9 is a bottom view of the first tray and the second tray located at a third position.
Figure 10A:
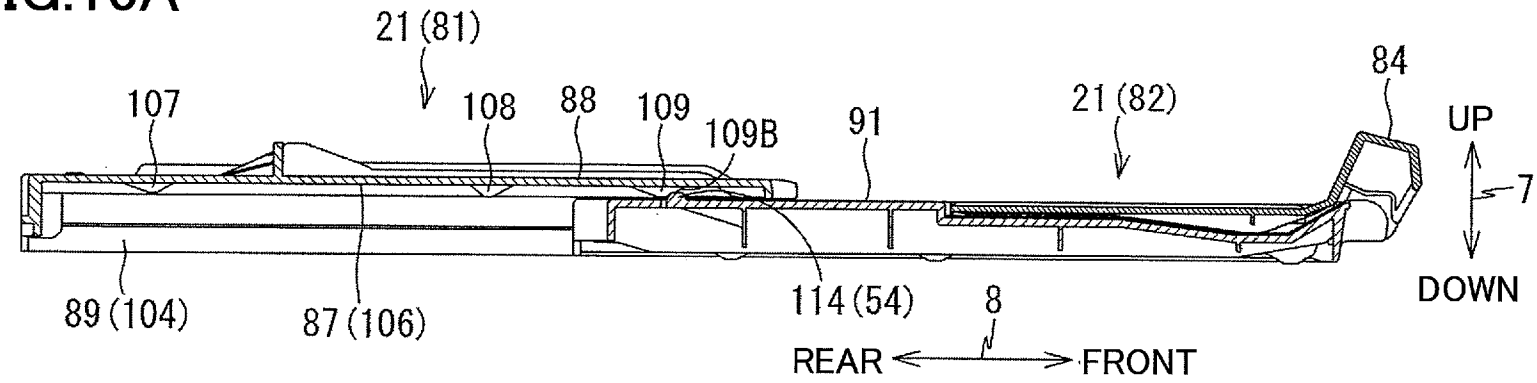
FIG. 10A is a cross-sectional view taken along line XA-XA in FIG. 9.
Figure 10B:
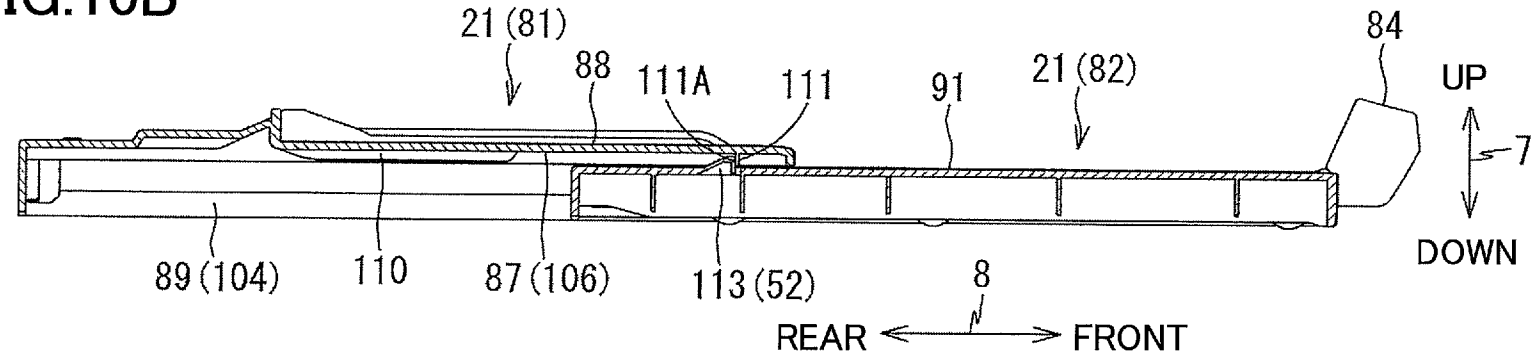
FIG. 10B is a cross-sectional view taken along line XB-XB in FIG. 9.

The output tray 21 is used in a state illustrated in FIGS. 9, 10A, and 10B in the case where image recording is performed on the sheet 15 of a size, such as the B4 size and the legal size, which is larger than the sizes of the sheet 15 used in the case where the output tray 21 is in the state illustrated in FIGS. 7, 8A, and 8B. That is, the second tray 82 is drawn out from the first tray 81 by an amount that is larger than that in the case where the output tray 21 is in the state illustrated in FIGS. 7, 8A, and 8B. That is, the second tray 82 being in the state illustrated in FIGS. 9, 10A, and 10B is located further toward the front than when located at the second position illustrated in FIGS. 7, 8A, and 8B. In other words, a front end of the second tray 82 being in the state illustrated in FIGS. 9, 10A, and 10B is located further toward the front than when located at the second position illustrated in FIGS. 7, 8A, and 8B. When the output tray 21 is in the state illustrated in FIGS. 9, 10A, and 10B, the sheet 15 discharged frontward from the inside of the housing 14 is supported by the upper surface 88 and the upper surface 91.

In the state illustrated in FIGS. 9, 10A, and 10B, a rear end portion of the upper surface 91 of the second tray 82 overlaps the upper surface 88 of the support plate 87 of the first tray 81 in plan view. The overlapping area between the upper surface 91 of the second tray 82 in this state and the upper surface 88 of the support plate 87 of the first tray 81 is smaller than the overlapping area between the upper surface 91 of the second tray 82 located at the second position and the upper surface 88 of the support plate 87 of the first tray 81. The position of the second tray 82 illustrated in FIGS. 9, 10A, and 10B is defined as a third position.

First Tray 81

As illustrated in FIG. 3, the first tray 81 includes: the support plate 87 shaped like a plate whose thickness direction coincides with the up and down direction 7; and the pair of side plates 89 protruding downward respectively from right and left end portions of the support plate 87. The upper surface 88 of the support plate 87 extends in the front and rear direction 8 and the right and left direction 9 so as to support the sheet 15 discharged from the MFP 10.

A pair of outer extending members 102 each protruding in the right and left direction 9 and extending in the front and rear direction 8 are respectively provided on outer surfaces 101 of the respective side plates 89 in the right and left direction 9, i.e., a right surface of the right side plate 89 and a left surface of the left side plate 89. The pair of outer extending members 102 are supported by supporters, not illustrated, which protrude respectively from the pair of inside surfaces 75 of the housing 14 (see FIG. 1) in the right and left direction 9. With this construction, the first tray 81 is supported by the housing 14.

A pair of inner extending members 104 each protruding in the right and left direction 9 and extending in the front and rear direction 8 are respectively provided on inner surfaces 103 of the respective side plates 89 in the right and left direction 9, i.e., a left surface of the right side plate 89 and a right surface of the left side plate 89. The inner extending members 104 respectively support outer extending members 112 of the second tray 82, which will be described below.

A pair of inner protrusions 105 each protruding in the right and left direction 9 are provided above each of the pair of inner extending members 104 of the inner surfaces 103. Each of the inner protrusions 105 is opposed to and spaced apart from a corresponding one of the inner extending members 104 in the up and down direction 7.

A lower surface 106 of the support plate 87 extends in the front and rear direction 8 and the right and left direction 9. The lower surface 106 is provided with rear protrusions 107 protruding downward, central protrusions 108 (each as one example of a second friction portion), front protrusions 109 (each as one example of a third friction portion), ribs 110 (each as one example of a first friction portion), and limiters 111.

The rear protrusions 107 are provided on a rear end portion of the support plate 87. The front protrusions 109 are provided on a front end portion of the support plate 87. Each of the central protrusions 108 is provided between a corresponding one of the rear protrusions 107 and a corresponding one of the front protrusions 109 in the front and rear direction 8. Each rear protrusion 107, the corresponding central protrusion 108, and the corresponding front protrusion 109 are located at the same position in the right and left direction 9.

As illustrated in FIG. 6A, each of the rear protrusions 107 has: an inclined surface 107A inclined from a rear end of the rear protrusion 107 so as to be lower at its front portion than at its rear portion; and an inclined surface 107B inclined from a front end of the inclined surface 107A so as to be higher at its front portion than at its rear portion. The angle of the inclined surface 107A with respect to the lower surface 106 is smaller than that of the inclined surface 107B with respect to the lower surface 106.

Each of the central protrusions 108 has: an inclined surface 108A inclined from a rear end of the central protrusion 108 so as to be lower at its front portion than at its rear portion, and an inclined surface 108B inclined from a front end of the inclined surface 108A so as to be higher at its front portion than at its rear portion. The angle of the inclined surface 108A with respect to the lower surface 106 is greater than that of the inclined surface 108B with respect to the lower surface 106.

Each of the front protrusions 109 has: an inclined surface 109A inclined from a rear end of the front protrusion 109 so as to be lower at its front portion than at its rear portion; and an inclined surface 109B inclined from a front end of the inclined surface 109A so as to be higher at its front portion than at its rear portion. The angle of the inclined surface 109A with respect to the lower surface 106 is smaller than that of the inclined surface 109B with respect to the lower surface 106.

As illustrated in FIG. 3, a position of each set of ribs 110 in the right and left direction 9 is different from the positions of the rear protrusions 107, the central protrusions 108, and the front protrusions 109 in the right and left direction 9. In the present embodiment, each set of ribs 110 is located farther from the center of the first tray 81 and the second tray 82 in the right and left direction 9 than a corresponding one of the rear protrusions 107, a corresponding one of the central protrusions 108, and a corresponding one of the front protrusions 109.

Each of the ribs 110 extends along the front and rear direction 8. A rear end of the rib 110 is located between the rear protrusion 107 and the central protrusion 108 in the front and rear direction 8. A front end of the rib 110 is located between the central protrusion 108 and the front protrusion 109.

As illustrated in FIG. 6B, each of the ribs 110 has: an inclined surface 110A (as one example of a first inclined surface) inclined from the rear end of the rib 110 so as to be lower at its front portion than at its rear portion; and an inclined surface 110B (as one example of a second inclined surface) inclined from the front end of the rib 110 so as to be lower at its rear portion than at its front portion. The inclined surface 110A, 110B are respectively provided on a rear end portion and a front end portion of a protruding distal end surface of the rib 110. The angle of the inclined surface 110A with respect to the lower surface 106 is smaller than that of the inclined surface 110B with respect to the lower surface 106. While the inclined surface 110A and the inclined surface 110B are respectively provided on a rear end portion and a front end portion of the rib 110 in the present embodiment, the inclined surface 110A may extend further toward the front than in the present embodiment, and the inclined surface 110B may extend further toward the rear than in the present embodiment.

Each of the limiters 111 and a corresponding set of the ribs 110 are located at the same position in the right and left direction 9. The limiters 111 are provided on the front end portion of the support plate 87. Each of the limiters 111 has a limiting surface 111A. The limiting surface 111A faces rearward and extends in the up and down direction 7 and the right and left direction 9. The limiting surfaces 111A of the limiters 111 are respectively in contact with protrusions 52 of first contact portions 113, which will be described below, of the second tray 82 located at the third position, whereby the limiters 111 prevent frontward movement of the second tray 82 located at the third position.

While the rear protrusions 107, the central protrusions 108, the front protrusions 109, the sets of ribs 110, and the limiters 111 are provided in pairs and spaced apart from each other in the right and left direction 9 in the present embodiment, these components need not be provided in pairs. For example, a single rear protrusion 107, a single central protrusion 108, a single front protrusion 109, a single rib 110, and a single limiter 111 may be provided.

Second Tray 82

As illustrated in FIG. 4, the second tray 82 is shaped like a plate whose thickness direction coincides with the up and down direction 7. The upper surface 91 of the second tray 82 extends in the front and rear direction 8 and the right and left direction 9 so as to support the sheet 15 discharged from the MFP 10.

As illustrated in FIG. 1, the protruding portion 84 is provided on a front surface 115 of the second tray 82 so as to protrude frontward and upward. A user holds the protruding portion 84 to draw out the second tray 82 from the first tray 81. Also, the protruding portion 84 prevents frontward movement of the sheet 15 by contact with a leading end (front end) of the sheet 15 discharged on the output tray 21. FIG. 4 omits illustration of the protruding portion 84.

As illustrated in FIG. 4, the pair of outer extending members 112 are respectively provided on a right surface 85 and a left surface 86 of the second tray 82. The outer extending members 112 protrude in the right and left direction 9 and extend in the front and rear direction 8. The inner extending members 104 of the first tray 81 support the respective outer extending members 112. In this state, the inner protrusions 105 provided on the first tray 81 are located over the outer extending members 112. As a result, each of the outer extending members 112 is nipped between the inner extending member 104 and the inner protrusions 105, so that the second tray 82 is supported by the first tray 81 so as to be movable in the front and rear direction 8.

The first contact portions 113 and second contact portions 114 are provided on the upper surface 91 of the second tray 82. The first contact portions 113 apply a load to the first tray 81 by contact of the protrusions 52, which will be described below, with the respective sets of ribs 110 provided on the first tray 81, thereby generating a frictional force between the second tray 82 and the first tray 81. The second contact portions 114 also apply a load to the first tray 81 by contact of protrusions 54, which will be described below, with the respective rear protrusions 107, the respective central protrusions 108, and the respective front protrusions 109 provided on the first tray 81, thereby generating a frictional force between the second tray 82 and the first tray 81.

Each of the first contact portions 113, a corresponding set of ribs 110, and a corresponding one of the limiters 111 of the first tray 81 are located at the same position in the right and left direction 9. This construction enables the first contact portions 113 to contact the respective sets of ribs 110 and the respective limiters 111 in the state in which the second tray 82 is supported by the first tray 81.

Each of the first contact portions 113 includes a plate portion 51 and the protrusion 52 protruding upward from the plate portion 51. The plate portion 51 is defined by a generally U-shaped slit 56 formed in the upper surface 91. The plate portion 51 is bendable in the up and down direction 7 about a portion of the plate portion 51 which is continuous to the upper surface 91. This construction enables the protrusions 52 to move in the up and down direction 7. In view of the above, the first contact portions 113 are elastically deformable.

Each of the second contact portions 114, a corresponding one of the rear protrusions 107, a corresponding one of the central protrusions 108, and a corresponding one of the front protrusions 109 of the first tray 81 are located at the same position in the right and left direction 9. That is, the second contact portions 114 are located at different positions in the right and left direction 9 from the first contact portions 113. In the present embodiment, each of the first contact portions 113 is located farther from the center of the first tray 81 and the second tray 82 in the right and left direction 9 than a corresponding one of the second contact portions 114. This construction enables the second contact portions 114 to contact the respective rear protrusions 107, the respective central protrusions 108, and the respective front protrusions 109 of the first tray 81 in the state in which the second tray 82 is supported by the first tray 81.

Each of the second contact portions 114 includes a plate portion 53 and the protrusion 54 protruding upward from an upper surface of the plate portion 53. The plate portion 53 is defined by a generally U-shaped slit 57 formed in the upper surface 91. The plate portion 53 is bendable in the up and down direction 7 about a portion of the plate portion 53 which is continuous to the upper surface 91. This construction enables the protrusions 54 to move in the up and down direction 7. In view of the above, the second contact portions 114 are elastically deformable.

Each of the plate portions 53 includes a rib 55 (see FIG. 5) on a lower surface of the plate portion 53 which is the back of the plate portion 53 from its upper surface on which the protrusion 54 is provided. The plate portion 51 in contrast does not include any rib on a surface of the plate portion 51 which is the back of the plate portion 51 from its upper surface on which the protrusion 52 is provided. Thus, the plate portion 53 is more difficult to bend than the plate portion 51. Accordingly, the greatest frictional force between the second tray 82 and the first tray 81 due to elastic deformation of the first contact portions 113 which is caused by contact of the protrusions 54 with the respective rear protrusions 107, the respective central protrusions 108, and the respective front protrusions 109 of the first tray 81 is greater than the greatest frictional force between the second tray 82 and the first tray 81 due to elastic deformation of the second contact portions 114 which is caused by contact of the protrusions 52 with the respective sets of ribs 110. It is noted that a means for providing a difference in easiness of bending between the plate portions 51, 53 is not limited to the ribs 55. For example, a difference in easiness of bending between the plate portions 51, 53 may be provided by making a protruding length of each of the rear protrusions 107, the central protrusions 108, and the front protrusions 109 from the lower surface 106 longer than that of each of the ribs 110 from the lower surface 106.

While each pair of the first contact portions 113 and the second contact portions 114 are spaced apart from each other in the right and left direction 9 in the present embodiment, these components need not be provided in pairs. For example, a single first contact portion 113 and a single second contact portion 114 may be provided.

Drawing Operation

Figure 11:
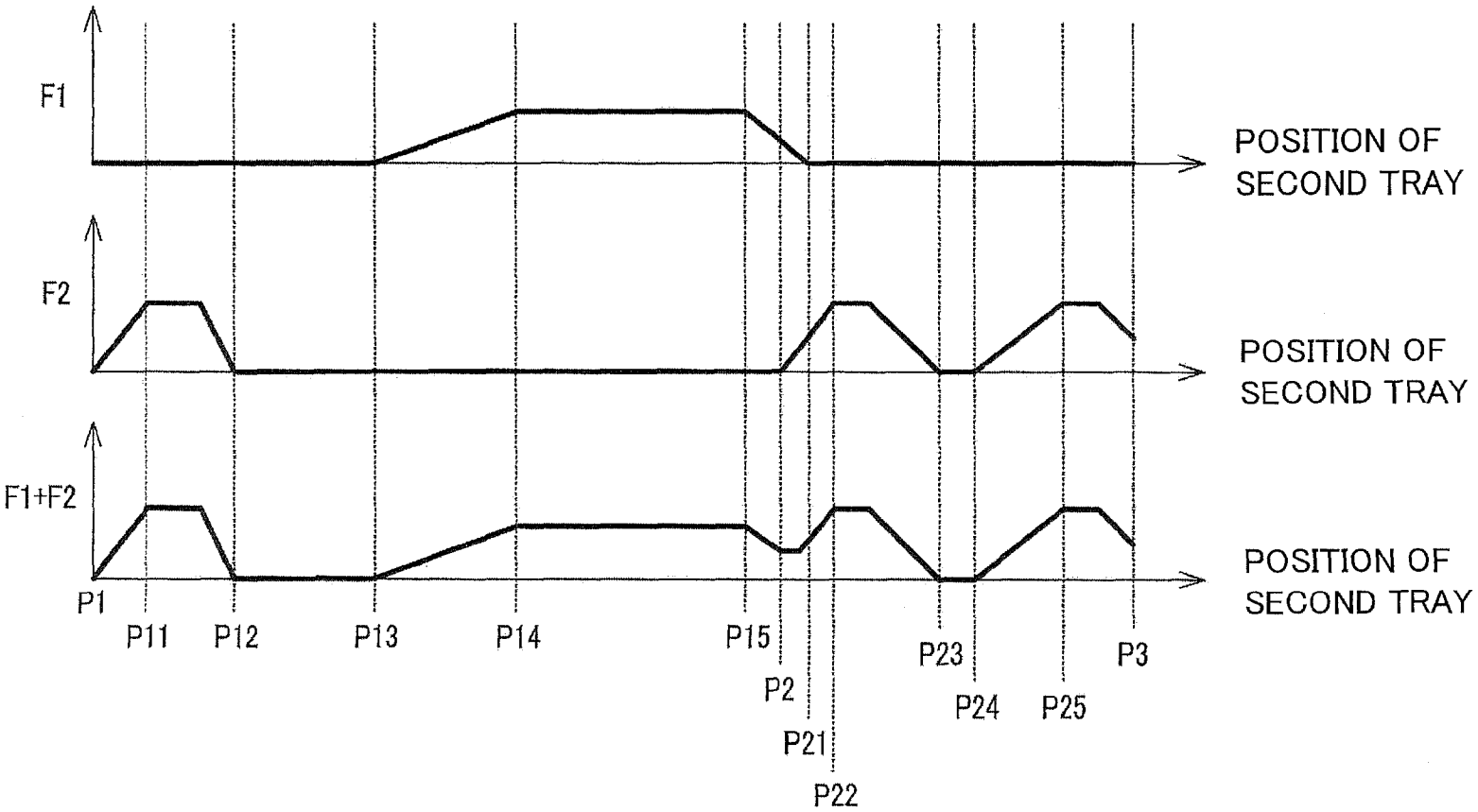
FIG. 11 is a diagram illustrating a relationship among loads F1, F2, F1+F2 with respect to the positions of the second tray.

There will be next explained, with reference to FIGS. 6A, 6B, 8A, 8B, 10A, 10B, and 11, an operation of the user who holds the protruding portion 84 of the second tray 82 and draws out the second tray 82 from the first tray 81. It is noted that FIG. 11 illustrates a relationship among loads F1, F2, F1+F2 with respect to the positions of the second tray 82. Here, the load F1 is a load which acts on the second tray 82 from the first tray 81 via the first contact portions 113, and the load F2 is a load which acts on the second tray 82 from the first tray 81 via the second contact portions 114.

In the state illustrated in FIGS. 5, 6A, and 6B, the second tray 82 is located at the first position P1 (see FIG. 11). In this state, the second tray 82 other than the protruding portion 84 is held on the first tray 81.

As illustrated in FIG. 6A, a basal end portion 84A of the protruding portion 84 of the second tray 82 is held in contact with a front end 87A of the support plate 87 of the first tray 81, thereby preventing rearward movement of the second tray 82 located at the first position P1. Also, the protrusions 54 of the second contact portions 114 of the second tray 82 located at the first position P1 are held in contact with the respective rear protrusions 107 of the first tray 81. As a result, a load is required for frontward movement of the second tray 82 located at the first position P1 because the protrusions 54 have to move beyond the respective rear protrusions 107 for the frontward movement of the second tray 82 located at the first position P1.

When the protruding portion 84 is held and pulled frontward by the user in the state illustrated in FIGS. 5, 6A, and 6B, the second tray 82 is moved frontward with respect to the first tray 81. This movement presses the protrusions 54 of the respective second contact portions 114 against rear portions of the inclined surfaces 107A of the respective rear protrusions 107 of the first tray 81. As a result, the protrusions 54 are moved downward, and the plate portions 53 of the respective second contact portions 114 are bent. That is, the second contact portions 114 are elastically deformed. With this deformation, the load F2 increases until the second tray 82 reaches the position P11 (P1-P11 in FIG. 11A).

When the second tray 82 is moved frontward from the position P11, the protrusions 54 are moved beyond the respective rear protrusions 107 and spaced apart from the respective rear protrusions 107. As a result, the protrusions 54 are moved upward, and the bending of the plate portions 53 of the respective second contact portions 114 is cancelled. That is, each of the second contact portions 114 is elastically returned to its original shape. The load F2 decreases with this restoration (P11-P12 in FIG. 11A).

When the second tray 82 is moved frontward from the position P12 to the position P13, the protrusions 52 of the respective first contact portions 113 are brought into contact with and pressed against rear portions of the inclined surfaces 110A of the respective sets of ribs 110 of the first tray 81. As a result, the protrusions 52 are moved downward, and the plate portions 51 of the respective first contact portions 113 are bent. That is, the first contact portions 113 are elastically deformed. With this deformation, the load F1 increases until the second tray 82 reaches the position P14 (P13-P14 in FIG. 11A). In view of the above, the sets of ribs 110 contact and elastically deform the respective first contact portions 113 in the process of the movement of the second tray 82 from the first position P1 to the second position P2.

The second tray 82 is moved frontward from the position P14 in the state in which the first contact portions 113 are elastically deformed. When the second tray 82 has reached the position P15, the protrusions 52 are brought into contact with the inclined surfaces 110B of the respective sets of ribs 110 and guided along the respective inclined surfaces 110B. As a result, the protrusions 52 are moved upward, and the bending of the plate portions 53 of the respective first contact portions 113 is cancelled. That is, each of the first contact portions 113 is elastically returned to its original shape. The load F1 decreases with this restoration (P15-P21 in FIG. 11A). In view of the above, each set of ribs 110 starts elastically returning the corresponding first contact portion 113 to its original shape at the point in time when the second tray 82 is located at the position P15 that is further toward the rear than the second position P2. In the present embodiment, the load F1 becomes zero at the point in time when the second tray 82 has reached the position P21 that is further toward the front than the second position P2.

At the point in time when the second tray 82 has reached the second position P2 (see FIG. 8) between the position P15 and the position P21, the protrusions 54 come into contact with rear portions of the inclined surfaces 108A of the respective central protrusions 108 of the first tray 81. When the second tray 82 is moved frontward from the second position P2, the protrusions 54 are pressed against the respective central protrusions 108. This operation elastically deforms the second contact portions 114. With this deformation, the load F2 increases until the second tray reaches the position P22 (P2-P22 in FIG. 11A). In view of the above, at the point in time when the second tray 82 moving frontward from the first position P1 has reached the second position P2, the central protrusions 108 contact the respective second contact portions 114, and when the second tray 82 is moved frontward from the second position P2, the central protrusions 108 elastically deform the respective second contact portions 114 while being in contact therewith.

Since the load acts on the second tray 82 as described above, there is a region in which the sum of the loads F1, F2 temporarily decreases in a state in which the second tray 82 is located at or near the second position P2. Specifically, the region is located between the positions P15 and P22, and the sum of the loads F1, F2 is the smallest between the second position P2 and the position P21. This region enables the load F2 to increase just after the load F1 decreases. As a result, a click feeling indicating that the second tray 82 has reached the second position P2 is applied to the user.

A load is required for frontward movement of the second tray 82 located at the second position P2 because the protrusions 54 have to move beyond the respective central protrusions 108 for the frontward movement of the second tray 82 located at the second position P2. A load is also required for rearward movement of the second tray 82 located at the second position P2 because the protrusions 52 have to move beyond the respective sets of ribs 110 for the rearward movement of the second tray 82 located at the second position P2.

When the second tray 82 is moved frontward from the position P22, the protrusions 54 are moved beyond the respective central protrusions 108 and spaced apart from the respective central protrusions 108. As a result, each of the second contact portions 114 is elastically returned to its original shape. The load F2 decreases with this restoration (P22-P23 in FIG. 11A). In view of the above, each of the central protrusions 108 elastically returns the corresponding second contact portion 114 to its original shape in the process of the movement of the second tray 82 from the second position P2 to the third position P3.

When the second tray 82 is moved frontward from the position P23 to the position P24, the protrusions 54 are brought into contact and pressed against rear portions of the inclined surfaces 109A of the respective front protrusions 109 of the first tray 81. As a result, the second contact portions 114 are elastically deformed. With this deformation, the load F2 increases until the second tray 82 reaches the position P25 (P24-P25 in FIG. 11A). In view of the above, the front protrusions 109 contact and elastically deform the respective second contact portions 114 at positions which are further toward the front than the central protrusions 108 in the process of the movement of the second tray 82 from the second position P2 to the third position P3.

When the second tray 82 is moved frontward from the position P25, the protrusions 54 come into contact with the inclined surfaces 109B of the respective front protrusions 109. As a result, each of the second contact portions 114 is elastically returned to its original shape. That is, the load F2 decreases. The second tray 82 reaches the third position P3 (see FIGS. 10A and 10B) during a period in which each of the second contact portions 114 is elastically returned to its original shape. That is, each of the front protrusions 109 elastically returns the corresponding second contact portion 114 to its original shape in the state in which the second tray 82 is located at the third position P3. It is noted that the second tray 82 may reach the third position P3 after the completion of the elastic returning of each of the second contact portions 114 to its original shape.

When the second tray 82 is located at the third position P3, the protrusions 52 of the respective first contact portions 113 are in contact with the limiting surfaces 111A of the respective limiters 111 (see FIG. 10B), thereby preventing frontward movement of the second tray 82. It is noted that a load is required for rearward movement of the second tray 82 located at the third position P3 because the protrusions 54 have to move beyond the respective front protrusions 109 for the rearward movement of the second tray 82 located at the third position P3.

An operation of pushing the second tray 82 into the first tray 81 is performed in the order reverse to the order of the operation of drawing the second tray 82 from the first tray 81. That is, the second tray 82 located at the third position P3 is moved rearward toward the first position P1 via the second position P2.

In this movement, the load F1 increases by pressing contact of the protrusions 52 with the respective sets of ribs 110 just after the load F2 decreases by movement of the protrusions 54 beyond the respective central protrusions 108. As a result, a click feeling indicating that the second tray 82 has reached the second position P2 is applied to the user. Also, just after the load F2 decreases by movement of the protrusions 54 beyond the respective rear protrusions 107, the basal end portion 84A of the protruding portion 84 of the second tray 82 (see FIG. 6A) comes into contact with the front end 87A of the support plate 87 of the first tray 81 (see FIG. 6A). As a result, the second tray 82 reaches the first position P1.

Effects

In the present embodiment, in the case where the second tray 82 is moved frontward from the first position P1 with respect to the first tray 81, the first contact portions 113 are elastically deformed to increase a sliding frictional force of the second tray 82 with respect to the first tray 81. The increased sliding frictional force reduces the speed of movement of the second tray 82, resulting in a low possibility that the second tray 82 passes through the second position P2 even though the second contact portions 114 are elastically deformed.

Since the speed of movement of the second tray 82 can be reduced as described above, it is possible to construct the first tray 81 and the second tray 82 with a smaller sliding frictional force of the second tray 82 with respect to the first tray 81 due to the elastic deformation of the second contact portions 114. This construction facilitates forward movement of the second tray 82 located at the second position P2.

If each of the central protrusions 108 and the corresponding set of ribs 110 are located at the same position in the right and left direction 9, and each of the first contact portions 113 and the corresponding second contact portion 114 are constructed as a common contact portion, the following problem arises. That is, in the case where the second tray 82 is moved frontward from the first position P1 with respect to the first tray 81, the contact portion elastically deformed by the set of ribs 110 may come into contact with the central protrusion 108 in a state in which the contact portion is elastically deformed. In this case, the sliding frictional force of the second tray 82 with respect to the first tray 81 is small at the second position P2, unfortunately. In the present embodiment, to solve this problem, the position in the right and left direction 9 of each of the first contact portions 113 and the corresponding set of ribs 110 is different from the position in the right and left direction 9 of each of the second contact portions 114 and the corresponding central protrusion 108. Thus, when the second tray 82 is located at the second position P2, the second contact portions 114 are in contact with the respective central protrusions 108 in the state in which the second contact portions 114 are not elastically deformed. This contact maintains a large sliding frictional force of the second tray 82 with respect to the first tray 81 due to the elastic deformation of the second contact portions 114 when the second tray 82 is moved frontward from the second position P2.

In the present embodiment, the second tray 82 is located further toward the rear than the second position P2 at the point in time when each first contact portion 113 starts elastically returning to its original shape. Thus, in the case where the second tray 82 is moved frontward from the first position P1 with respect to the first tray 81, each first contact portion 113 starts elastically returning to its original shape, and after the sliding frictional force of the second tray 82 with respect to the first tray 81 decreases, the elastic deformation of the second contact portions 114 is started, resulting in increase in the sliding frictional force of the second tray 82 with respect to the first tray 81. This increase in the sliding frictional force applies the click feeling to the user moving the second tray 82, when the second tray 82 has reached the second position P2.

In the present embodiment, each of the first contact portions 113 and a corresponding set of ribs 110 are located farther from the center of the first tray 81 and the second tray 82 in the right and left direction 9 than a corresponding one of the second contact portions 114 and a corresponding one of the central protrusions 108. This construction reduces a twist in the second tray 82 which is caused by, e.g., movement of one end portion of the second tray 82 in the right and left direction 9 by a larger amount than the other end portion when the second tray 82 is moved in the front and rear direction 8.

In the present embodiment, each of the central protrusions 108 elastically returns the corresponding second contact portion 114 to its original shape in the process of the movement of the second tray 82 from the second position P2 to the third position P3. This construction enables the user to clearly recognize that the second tray 82 is moved off the second position P2 when the second tray 82 is moved frontward from the second position P2.

In the present embodiment, when the second tray 82 located at the third position P3 is moved rearward, the second contact portions 114 are elastically deformed by contact with the respective front protrusions 109. This deformation increases the sliding frictional force of the second tray 82 with respect to the first tray 81. This increased sliding frictional force reduces a possibility of unintended movement of the second tray 82 located at the third position P3 toward the second position P2.

In the present embodiment, the output tray 21 includes the limiters 111, thereby preventing unintended frontward movement of the second tray 82 located at the third position P3.

In the present embodiment, the inclined surface 110A is gentler than the inclined surface 110B. Thus, the first contact portions 113 are gradually deformed elastically in the case where the second tray 82 is moved frontward from the first position P1 with respect to the first tray 81. This construction makes it possible to clearly distinguish between an operation feeling of the second tray 82 in the process of the movement of the second tray 82 from the first position P1 to the second position P2 and an operation feeling of the second tray 82 when the second tray 82 has reached the second position P2.

In the present embodiment, the frictional force between the second contact portions 114 and the central protrusions 108 which is generated by the elastic deformation of the second contact portions 114 having contacted the respective central protrusions 108 keeps the second tray 82 at the second position P2. On the other hand, the frictional force between the first contact portions 113 and the respective sets of ribs 110 which is generated by the elastic deformation of the first contact portions 113 having contacted the respective sets of ribs 110 does not keep the second tray 82 at a particular position. Accordingly, the greatest frictional force between the second contact portions 114 and the central protrusions 108 is preferably greater than the greatest frictional force between the first contact portions 113 and the sets of ribs 110 as in the present embodiment.

Modifications

In the above-described embodiment, the load F1 becomes zero at the point in time when the second tray 82 has reached the position P21 that is further toward the front than the second position P2. However, the timing when the load F1 becomes zero is not limited to the point in time when the second tray 82 has reached the position P21, on condition that there is a region in which the sum of the loads F1, F2 temporarily decreases in the state in which the second tray 82 is located at or near the second position P2. For example, the timing may be the point in time when the second tray 82 has reached the second position P2 or the point in time when the second tray 82 is located at a position that is further toward the rear than the second position P2.

In the above-described embodiment, the first tray 81 includes the rear protrusions 107, the central protrusions 108, the front protrusions 109, the ribs 110, and the limiters 111, and the second tray 82 includes the first contact portions 113 and the second contact portions 114. However, the second tray 82 may include the rear protrusions 107, the central protrusions 108, the front protrusions 109, the ribs 110, and the limiters 111, and the first tray 81 may include the first contact portions 113 and the second contact portions 114.

In one example, this MFP 10 may be constructed such that the first tray 81 includes the first contact portions 113 and the second contact portions 114, and the second tray 82 includes the rear protrusions 107, the central protrusions 108, the front protrusions 109, the ribs 110, and the limiters 111.

In another example, this MFP 10 may be constructed such that the first tray 81 includes the rear protrusions 107, the central protrusions 108, the front protrusions 109, and the first contact portions 113, and the second tray 82 includes the ribs 110, the limiters 111, and the second contact portions 114.

In still another example, this MFP 10 may be constructed such that the first tray 81 includes the ribs 110, the limiters 111, and the second contact portions 114, and the second tray 82 includes the rear protrusions 107, the central protrusions 108, the front protrusions 109, and the first contact portions 113.

In the above-described embodiment, the first contact portions 113 are elastically deformed by bending of the respective plate portions 51, and the second contact portions 114 are elastically deformed by bending of the respective plate portions 53. However, the first contact portions 113 and the second contact portions 114 may be elastically deformed by means different from the bending of the plate portions 51, 53.

In one example, each of the first contact portions 113 and the second contact portions 114 may be constituted only by a protrusion protruding from the upper surface 91 of the second tray 82. In this construction, each of the first contact portions 113 and the second contact portions 114 is elastically deformed by elastic deformation of the protrusion itself. In another example, each of the first contact portions 113 and the second contact portions 114 may be constituted by (i) a plate portion disposed in an opening formed in the second tray 82 and (ii) a coil spring connected to the plate portion. In this construction, each of the first contact portions 113 and the second contact portions 114 is elastically deformed by movement of the plate portion in the up and down direction 7 by extension and contraction of the coil spring.

While the output tray 21 that supports the sheet 15 on which an image has been recorded by the printer 12 is one example of the sheet tray in the above-described embodiment, the sheet tray is not limited to the output tray 21. For example, the sheet tray may be the supply tray 20.

The sheet tray may be provided on a device different from the printer 12. For example, the sheet tray may be a tray that supports a sheet for which an image has been read by the scanner 11.

What is claimed is:

1. A sheet tray, comprising:

a first tray comprising a first support surface that supports a sheet; and a second tray comprising a second support surface that supports the sheet, the second tray being movable with respect to the first tray in a first direction, wherein the second tray is movable to a first position, a second position, and a third position, wherein when the second tray is located at the first position, an overlapping area which is an area on which the second support surface overlaps the first support surface in plan view is a first area, wherein the second position is spaced apart from the first position at a first distance in the first direction, and when the second tray is located at the second position, the overlapping area is a second area which is less than the first area, wherein the third position is spaced apart from the second position at a second distance in the first direction, and when the second tray is located at the third position, the overlapping area is a third area which is less than the second area, wherein the first tray comprises: one of a first friction portion and a first contact portion deformable elastically; and one of a second friction portion and a second contact portion deformable elastically, wherein the second tray comprises: the other of the first friction portion and the first contact portion deformable elastically; and the other of the second friction portion and the second contact portion deformable elastically, wherein the second contact portion differs from the first contact portion in position in a widthwise direction which is orthogonal to the first direction and along the first support surface, wherein, in a process of movement of the second tray from the first position to the second position, the first friction portion contacts the first contact portion to elastically deform the first contact portion and thereafter starts elastically returning a shape of the first contact portion from an elastically deformed shape to an original shape thereof when the second tray is located at a position spaced apart from the second position at a third distance in a second direction reverse to the first direction, and wherein the second friction portion contacts the second contact portion at a point in time when the second tray moved from the first position in the first direction has reached the second position, and thereafter the second friction portion elastically deforms the second contact portion when the second tray is moved from the second position in the first direction.

2. The sheet tray according to claim 1, wherein the first contact portion and the first friction portion are located farther from a center of the first tray and the second tray in the widthwise direction than the second contact portion and the second friction portion in the widthwise direction.

3. The sheet tray according to claim 1, wherein the second friction portion elastically returns a shape of the second contact portion from an elastically deformed shape to an original shape thereof in a process of movement of the second tray from the second position to the third position.

4. The sheet tray according to claim 3, wherein one of the first tray and the second tray which one comprises the second friction portion comprises a third friction portion that, in the process of movement of the second tray from the second position to the third position, contacts the second contact portion to elastically deform the second contact portion at a position spaced apart from the second friction portion at a fourth distance in the first direction and elastically returns the shape of the second contact portion from the elastically deformed shape to the original shape thereof when the second tray is located at the third position.

5. The sheet tray according to claim 1, wherein one of the first tray and the second tray which one comprises the first friction portion comprises a limiter that contacts the first contact portion to limit movement of the second tray in the first direction when the second tray is located at the third position.

6. The sheet tray according to claim 1, wherein the first friction portion is a rib extending along the first direction and protruding in a protruding direction, and wherein a protruding distal end surface of the rib comprises:

a first-direction-side end portion located on a side of a center of the protruding distal end surface in the first direction;

a second-direction-side end portion located on a side of the center of the protruding distal end surface in the second direction;

a first inclined surface extending in the protruding direction with increase in distance from the second-direction-side end portion in the first direction; and a second inclined surface extending in the protruding direction with increase in distance from the first-direction-side end portion in the second direction.

7. The sheet tray according to claim 6, wherein an angle of the first inclined surface with respect to the first direction is less than an angle of the second inclined surface with respect to the first direction.

8. The sheet tray according to claim 1, wherein a greatest frictional force between the second contact portion and the second friction portion which is generated when the second contact portion is elastically deformed by contact thereof with the second friction portion is greater than a greatest frictional force between the first friction portion and the first contact portion which is generated when the first contact portion is elastically deformed by contact thereof with the first friction portion.

9. A sheet tray, comprising:

a first tray having a first support surface configured to support a sheet; and a second tray having a second support surface configured to support the sheet, the second tray being configured to move relative to the first tray in a first direction from a first position via a second position to a third position, the second support surface of the second tray located at the first position overlapping the first support surface by a first area, the second support surface of the second tray located at the second position overlapping the first support surface by a second area less than the first area, and the second support surface of the second tray located at the third position overlapping the first support surface by a third area less than the second area, wherein the first tray includes: one of a first friction portion and a first contact portion deformable elastically; and one of a second friction portion and a second contact portion deformable elastically, wherein the second tray includes: the other of the first friction portion and the first contact portion; and the other of the second friction portion and the second contact portion, wherein the first contact portion and the second contact portion are located at different positions in a width direction which is orthogonal to the first direction and parallel to the first support surface, wherein the first friction portion is configured to:

when the second tray moves in the first direction from the first position toward the second position, contact and elastically deform the first contact portion to a deformed shape; and when the second tray reaches a position upstream of the second position in the first direction, start elastically returning the first contact portion from the deformed shape to an original shape, and wherein the second friction portion is configured to:

when the second tray reaches the second position from the first position, contact the second contact portion; and when the second tray leaves the second position in the first direction, elastically deform the second contact portion to a deformed shape.

10. The sheet tray according to claim 9, wherein the first contact portion and the first friction portion are located closer to one end of the first tray in the width direction than the second contact portion and the second friction portion.

11. The sheet tray according to claim 9, wherein the second friction portion is configured to, when the second tray moves toward the third position after leaving the second position, elastically return the second contact portion from the deformed shape to an original shape.

12. The sheet tray according to claim 11, wherein one of the first tray and the second tray which includes the second friction portion further includes a third friction portion, the third friction portion being configured to:

when the second tray reaches from the second position to a position downstream of the second position in the first direction, elastically deform the second contact portion from the original shape to a deformed shape; and when the second tray is located at the third position, elastically return the second contact portion from the deformed shape to the original shape.

13. The sheet tray according to claim 9, wherein one of the first tray and the second tray which includes the first friction portion further includes a limiter, the limiter being configured to, when the second tray is located at the third position, contact the first contact portion to limit movement of the second tray.

14. The sheet tray according to claim 9, wherein the first friction portion is a rib extending along the first direction and protruding in a protruding direction orthogonal to the first direction, the rib having:

a first inclined surface which is inclined with respect to the first direction such that a central portion of the rib between upstream and downstream end portions of the rib in the first direction protrudes further in the protruding direction than the upstream end portion; and a second inclined surface which is inclined with respect to the first direction such that the central portion protrudes further in the protruding direction than the downstream end portion.

15. The sheet tray according to claim 14, wherein an angle of the first inclined surface with respect to the first direction is less than an angle of the second inclined surface with respect to the first direction.

16. The sheet tray according to claim 1, wherein a greatest frictional force generated between the second friction portion and the second contact portion contacted and elastically deformed by the second friction portion is greater than a greatest frictional force generated between the first friction portion and the first contact portion contacted and elastically deformed by the first friction portion.

17. The sheet tray according to claim 1, wherein the second tray is configured to move relative to the first tray in a second direction opposite to the first direction from the third position via the second position to the first position.

* * * * *